United States Patent [19]

Stodola

[11] 4,099,430

[45] Jul. 11, 1978

[54] REWIND RATCHET WRENCH

[76] Inventor: Roger D. Stodola, Rte. 1, Becker, Minn. 55308

[21] Appl. No.: 754,077

[22] Filed: Dec. 23, 1976

[51] Int. Cl.[2] ..... B25B 13/00

[52] U.S. Cl. ..... 81/58.1; 81/59.1

[58] Field of Search ..... 81/58.1, 57.46, 59.1; 192/45

[56] References Cited

U.S. PATENT DOCUMENTS

| | | | |
|---|---|---|---|
| 1,306,553 | 6/1919 | Morrison | 81/58.1 |
| 1,719,881 | 7/1929 | Farmer | 81/59.1 X |
| 1,903,514 | 4/1933 | Merriman et al. | 81/57.46 |
| 2,292,391 | 8/1942 | Merriman et al. | 81/57.46 |
| 2,365,839 | 12/1944 | Pike | 81/58.1 |
| 2,690,689 | 10/1954 | Batcha | 81/58.1 |
| 3,572,188 | 3/1971 | Christian | 81/58.1 |

FOREIGN PATENT DOCUMENTS

| | | | |
|---|---|---|---|
| 598,140 | 9/1959 | Italy | 192/45 |
| 330,246 | 7/1958 | Switzerland | 192/45 |

*Primary Examiner*—James L. Jones, Jr.
*Attorney, Agent, or Firm*—Burd, Braddock & Bartz

[57] ABSTRACT

A wrench having an elongated handle attached to a head. A spool and rotatable member are rotatably mounted in the head. A one-way clutch drivably connects the spool with rotatable member. A cable wound around the spool extends longitudinally through the passage in the handle. When the cable is pulled out of the handle the spool is rotated. The one-way clutch drives the rotatable member which rotates without swinging the handle. A spring acting on the spool rotates the spool to wind the cable on the spool. A releasable lock interposed between the handle and the spool permits rotation of the spool in resonse to angular movement of the handle.

4 Claims, 5 Drawing Figures

REWIND RATCHET WRENCH

BACKGROUND OF THE INVENTION

Ratchet wrenches coupled to sockets are used by mechanics to turn threaded members, as nuts and bolts, that are located in cramped or relatively inaccessible locations. The handle of the conventional ratchet wrench is rotated or moved back and forth to rotate the socket. A conventional ratchet wrench is difficult to use to effect the tightening of a nut and bolt in confined or restricted spaces. Several forms of ratchet wrenches are disclosed in U.S. Pat. Nos. 1,214,423; 1,883,618; 2,536,172; 2,590,387; 2,686,446; 2,851,914; and 3,608,402.

Gegg in U.S. Pat. No. 3,952,617 discloses a wrench adapted to receive a socket and rotate the socket without angularly moving the handle. The handle is provided with a rotating sleeve that drives a shaft that extends longitudinally down the handle. A bevel gear arrangement in the head of the wrench affects the rotation of the member adapted to receive the socket. The handle must be twisted in order to achieve the rotation of the socket carrying member.

SUMMARY OF THE INVENTION

The invention is directed to a wrench having a handle secured to a head. The head has a cylindrical casing accommodating a rotatable spool carrying a rotatable body. One-way clutch means interposed between the body and the spool permits rotation of the body with the spool in one direction and allows the spool to freely rotate in the opposite direction. A cable is wound around the spool and extends longitudinally through a passage in the handle. A hand grip is attached to the free end of the cable to enable the user to pull the cable from the handle. Movement of the cable out of the handle rotates the spool thereby rotating the socket carrying member via the one-way clutch means. A coil spring interposed between the casing and spool is compressed with the cable is pulled from the handle. Once the force on the cable is released, the spring will rewind the spool whereby the cable will be wound around the sleeve.

An object of the invention is to provide a ratchet wrench that can rotate a threaded member without swinging of the handle of the wrench. A further object of the invention is to provide a ratchet wrench with a compact and protected arrangement of rotatable parts that can rotate a socket without angularly moving the handle of the wrench. A further object of the invention is to provide a ratchet wrench that can use conventional sockets and can rotate the sockets with either arcuately moving the handle of the wrench or without arcuately moving the handle of the wrench. These and other objects and features of the wrench of the invention are embodied in the following detailed description of the preferred embodiment of the invention. It is understood that other embodiments of the wrench can also satisfy the above advantages.

IN THE DRAWINGS

DESCRIPTION OF PREFERRED EMBODIMENT

Figure 1:
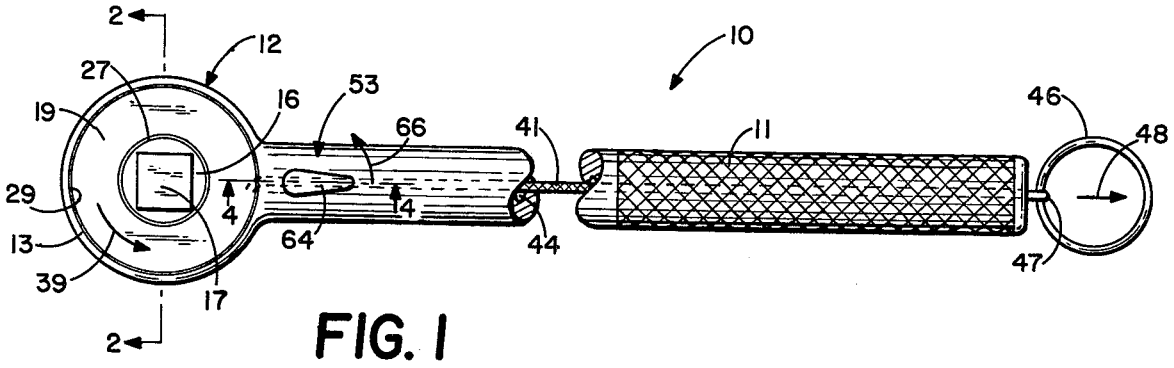
FIG. 1 is a foreshortened top plan view of the socket wrench of the invention.

Referring to FIG. 1, there is shown a wrench indicated generally at 10 for accommodating sockets or cylindrical members adapted to receive a nut or head of a bolt. Wrench 10 has an elongated linear cylindrical handle 11 attached to a circular head 12. Head 12 has a cylindrical casing 13 and an annular wall 14. Head 12 is a cup-shaped member that is integral with the inner end of handle 11.

A rotatable body or member 16 extends through head 12 along the central axis of casing 13. Body 16 has two male projections 17 and 18 extended in opposite directions from the end of the body. As shown in FIG. 11, male projection 17 has a square configuration and is of a size to fit into a square recess of a socket. One or more small balls can be carried by projections 17 and 18 to hold sockets on the projections. Multi-sided holes, as square, hexagonal and like-shaped holes, for accommodating male projections of sockets can be formed in the opposite ends of member 16 in lieu of projections 17 and 18.

Figure 2:
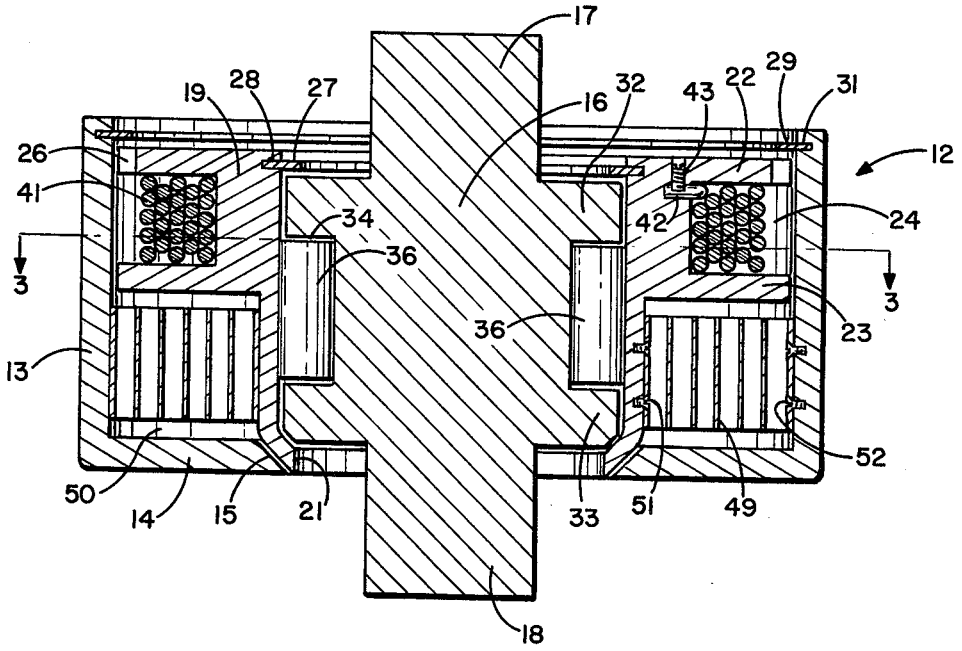
FIG. 2 is an enlarged sectional view taken along the line 2—2 of FIG. 1.

An annular spool or sleeve 19 is concentrically positioned about body 16 and located concentrically within annular cylindrical casing 13. As shown in FIG. 2, the lower portion of sleeve 16 has an inwardly inclined flange 21 located adjacent the inwardly inclined inner edge 15 of annular wall 14.

The upper end of spool 19 has a pair of outwardly directed ribs 22 and 23 forming an outwardly open annular channel 24. Rib 22 has an outer peripheral edge that has a plurality of circumferentially spaced teeth 26.

A first annular snap ring 27 located in a groove 28 in sleeve 19 projects a short distance inwardly over the top of a portion of body 16 to hold body 16 in rotating assembled relation with spool 19. A second snap ring 29 located in annular groove 31 in the upper portion of the inside wall of cylindrical casing 13 holds spool 19 in assembled relation with casing 13.

Figure 3:
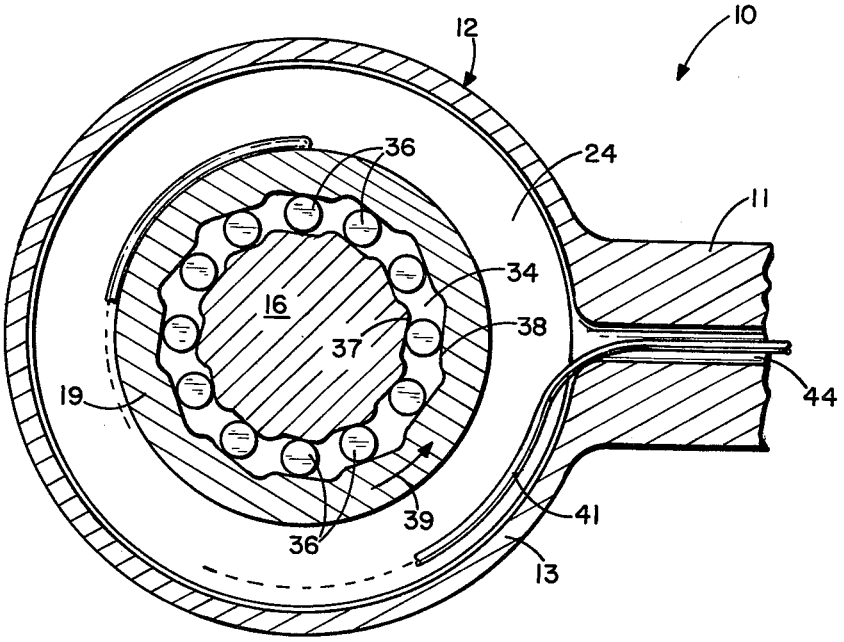
FIG. 3 is a sectional view taken along the line 3—3 of FIG. 2.

Body 16 has a pair of outwardly directed ribs or flanges 32 and 33. Flanges 32 and 33 have outside circumferential surfaces located in contiguous relationship with respect to the inside cylindrical surface of spool 19. Flanges 32 and 33 are spaced from each other forming an annular central groove 34 open to spool 19. A one-way drive means 36 is interposed in groove 34. Drive means 36 coacts with body 16 and spool 19 to drive body 16 and spool 19 concurrently in one direction and permit spool 19 to freely rotate in an opposite direction. As shown in FIG. 3, one-way drive means comprises a plurality of rollers 36 located in groove 34. Suitable balls can be used in lieu or rollers 36. The central portion of body 16 forming the base of groove 34 has a plurality of circumferentially oriented ramps 37 that engage rollers 36. The portion of spool 19 engageable with rollers 36 has circumferentially oriented ramps 38. Ramps 37 are inclined outwardly in the direction of the arrow 39. Ramps 38 are inclined outwardly in the circumferential direction opposite arrow 39. When spool 19 is rotated in the direction of arrow 39, the rollers 36 wedge between adjacent ramps 37 and 38, thereby drivably connecting spool 19 with body 16 so that body 16 rotates with spool 19. When spool 19 is rotated in a direction opposite arrow 39, rollers 36 move into the recesses of ramps 37 and 38 and move out of driving engagement with body 16. Spool 19 is free to rotate in the clockwise direction as shown in FIG. 3.

An elongated flexible cable 41 is wound around spool 19. As shown in FIG. 2, cable 41 is located in the annular channel 24. End 42 of cable 41 extends into a short recess or hole and is secured to spool 19 with a set screw 43. Other means can be used to attach the cable 41 to spool 19. As shown in FIGS. 1 and 3, handle 11 has an elongated central longitudinal passage 44. Cable 41 extends through passage 44 and out the outer or free end of handle 11. A ring 46 is attached to cable 41 with a connector 47. Ring 46 is a hand grip member which allows the user to pull cable 41 out of handle 11 in the direction of arrow 48. Ring 46 can be replaced with other types of hand grip members.

Returning to FIG. 2, a biasing means shown as a spiral coil flat spring 49 is located within casing 13 and around spool 19. Rib 23 is spaced above the bottom annular wall 14 forming an annular chamber 50 for accommodating spring 49. First fasteners 51, as a plurality of screws, secures the inner end of spring 49 to spool 19. Similar fasteners 52 secure the outer end of spring 49 to the inside of casing 13. Other types of fasteners or connecting structures can be used to attach spring 49 to spool 19 and casing 13. Spring 49 biases spool 19 in a circumferential direction that is opposite the direction of movement due to the pull on cable 41. In other words, after cable 41 has been pulled from the handle, spring 49 functions to rotate spool 19 to wind cable 41 back onto spool 19.

Figure 4:
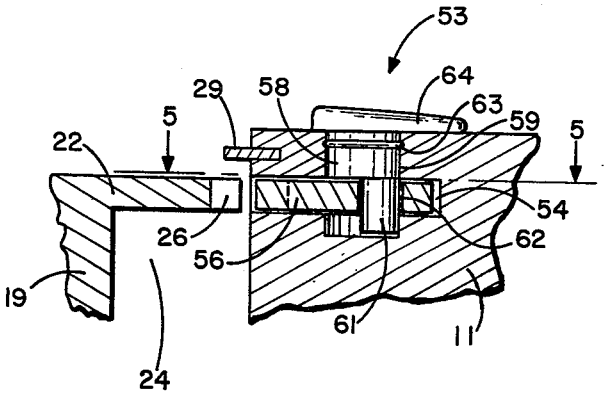
FIG. 4 is an enlarged sectional view taken along the line 4—4 of FIG. 1.
Figure 5:
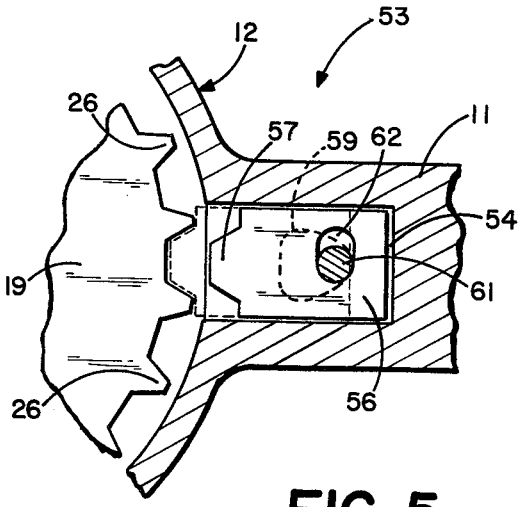
FIG. 5 is a sectional view taken along the line 5—5 of FIG. 4.

Returning to FIG. 1, a releasable lock indicated generally at 53 is mounted on the casing end of handle 11. Lock 53 is operable to lock spool 19 to handle 11 so that arcuate or swinging movement of handle 11 will rotate body 16. Referring to FIGS. 4 and 5, releasable lock 53 comprises a dog or finger 56 movably located in a slot 54 in handle 11. Slot 54 is open to the interior of casing 13 so that dog 56 is in radial alignment with teeth 26 on rib 22. Dog 56 has a locking tooth 57 that is positionable between adjacent teeth 26 and thereby lock spool 19 with handle 11. Dog 56 is moved to its locking and release positions with a control pin 58 located in a bore 59. An eccentric finger or member 61 secured to pin 58 extends through a slot 62 in dog 56. Snap ring 63 around pen 58 engages handle 11 to hold pin 58 and eccentric member 62 in assembled relation with handle 11. A short lever or arm 64 is secured to the outer end of pin 58. Lever 64 is moved in the direction of arrow 66, as shown in FIG. 1, to move dog 56 in the locking position, shown in broken lines in FIG. 5. Lock 53 is released by moving lever 64 in the opposite direction whereby the eccentric member 61 moves dog 56 back to the release or full line position as shown in FIG. 5.

Wrench 10 is used in locations where there is limited swing space for handle 11. Once the bolt or threaded member is broken loose, spool 19 can be rotated by pulling cable 41, thereby rapidly rotating the socket. This can be achieved without angular movement of handle 11. Handle 11 is held in a fixed position with one hand by the mechanic. The other hand is used to grip ring 46 and apply pulling force to cable 41. The movement of cable 41 out of handle 11 rotates spool 19. The one-way clutch rollers 36 rotate body 16 to thereby turn the socket mounted on one of male projections 17 or 18. Rotation of spool 19 compresses and tightens spring 49.

When the pulling force on cable 41 is released, spring 49 biases spool 19 in the opposite circumferential direction thereby winding cable 41 back onto spool 19. The one-way clutch permits spool 19 to rotate independently of body 16.

Wrench 10 can be used with either right or left hand threads. Male projections 17 and 18 are of a size to accommodate sockets, thereby wrench 10 has opposite circumferential rotational direction.

While there is shown and described a preferred embodiment of the wrench of the invention, it is understood that changes in the size, materials, and structures can be made by those skilled in the art without departing from the invention. The invention is defined in the following claims.

The embodiments of the invention in which an exclusive property or privilege is claimed are defined as follows:

1. In a wrench for rotating a socket or the like having an elongated handle with an annular head at one end and a longitudinal passage through the handle, said head having a cavity receiving a rotatable drive member having a drive projection, a sleeve in said cavity surrounding said rotatable member, one-way clutch means operable between said member and sleeve, a cable wound around the sleeve and extending outwardly through said handle passage for turning the sleeve and clutched drive member in one direction when pulled outwardly through said passage, and spring means coupled between said head and said sleeve biasing the sleeve to turn declutched in the other direction to rewind the cable around the sleeve, the improvement therein comprising:

said drive member having axially spaced radially outwardly extending annular flanges defining therebetween a circumferential groove, said one-way clutch means including an annular series of inclined ramps on said drive member between said flanges, a plurality of inclined ramps on said sleeve in concentric relation to said drive member, and a plurality of rollers disposed between said ramps and lying within and retained by said drive member groove, said head includes an annular inwardly extending flange at one end of said cavity, said sleeve includes an inwardly extending annular flange at one axial end thereof substantially engaging said head flange so as to restrict axial movement of said sleeve theretoward, one of said drive member flanges includes a portion thereof substantially engaging said sleeve flange so as to restrict axial movement of said drive member theretoward, and, means at the other end of said cavity and said sleeve to preclude axial movement of said sleeve and said drive member, respectively, therepast, thereby to maintain said wrench in assembled relation.

2. The improved wrench of claim 1 wherein said last named means comprise a snap ring carried by said sleeve to restrain said drive member and a snap ring carried by said head to restrain said sleeve.

3. The improved wrench of claim 1 further including cam means for selectively locking said head to said sleeve thereby to disable said clutch.

4. The improved wrench of claim 3 wherein said cam means is carried by said elongated handle and includes a member projectable from said handle into said cavity.

* * * * *

UNITED STATES PATENT AND TRADEMARK OFFICE

CERTIFICATE OF CORRECTION

PATENT NO. : 4,099,430

DATED : July 11, 1978

INVENTOR(S) : Roger D. Stodola

It is certified that error appears in the above-identified patent and that said Letters Patent are hereby corrected as shown below:

In the abstract, line 12, "resonse" should be --response--.

Column 1, line 41, "with" should be --when--.

Column 2, line 56, "or" should be --of--.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*